US005951105A

United States Patent [19]

Slettebø

[11] Patent Number: 5,951,105

[45] Date of Patent: Sep. 14, 1999

[54] ADJUSTABLE CHAIR

[76] Inventor: Tryggve Slettebø , Tyrihansveien 17, N-4300 Sandnes, Norway

[21] Appl. No.: 08/875,252

[22] PCT Filed: Jan. 30, 1996

[86] PCT No.: PCT/NO96/00020

§ 371 Date: Jul. 22, 1997

§ 102(e) Date: Jul. 22, 1997

[87] PCT Pub. No.: WO96/23435

PCT Pub. Date: Aug. 8, 1996

[30] Foreign Application Priority Data

Jan. 31, 1995 [NO] Norway ..... 950355

[51] Int. Cl.[6] ..... A47C 1/06

[52] U.S. Cl. ..... 297/338; 297/423.38; 297/423.26

[58] Field of Search ..... 297/338, 344.14, 297/344.18, 423.26, 423.38, 423.19

[56] References Cited

U.S. PATENT DOCUMENTS

| | | | |
|---|---|---|---|
| 1,026,782 | 5/1912 | Berggren | 297/423.26 |
| 2,691,411 | 10/1954 | Thatcher | 297/423.38 X |
| 2,717,027 | 9/1955 | Thatcher | 297/423.38 X |
| 4,768,831 | 9/1988 | Liedberg et al. | 297/423.38 X |
| 5,046,781 | 9/1991 | Ling | 297/338 |
| 5,167,436 | 12/1992 | Wu | 297/338 |
| 5,348,374 | 9/1994 | Kuo | 297/344.18 |
| 5,511,855 | 4/1996 | Miles | 297/338 X |
| 5,609,390 | 3/1997 | Takafuji | 297/338 X |

FOREIGN PATENT DOCUMENTS

| | | | |
|---|---|---|---|
| 544445 | 9/1959 | Belgium | 297/423.38 |
| 135118 | 11/1976 | Norway . | |
| 150743 | 9/1984 | Norway . | |

*Primary Examiner*—Peter M. Cuomo
*Assistant Examiner*—Rodney B. White
*Attorney, Agent, or Firm*—Andrus, Sceales, Starke & Sawall

[57] ABSTRACT

A chair having an adjustable seat and an ergonomically cooperating foot support to be used at high tables, wherein foot support for passive (closed) and active (open) sitting position automatically is adjusted to correct level below the seat and to correct horizontal distance from the seat front edge whenever the seat is adjusted to correct level below a tabletop in relation to the body of the user. Through a lifting strut (14), the seat (10) influences the rear foot support (15) which, through a sliding/pushing strut (20), influences the front foot support (24).

10 Claims, 2 Drawing Sheets

FIG. 1
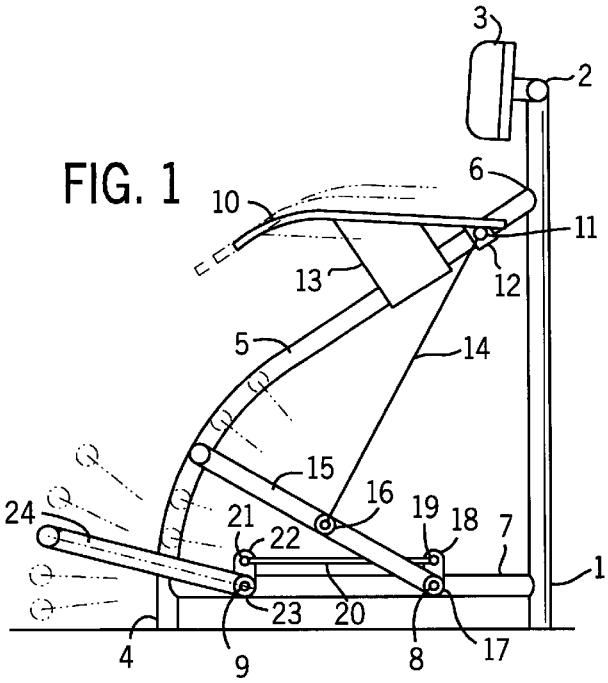
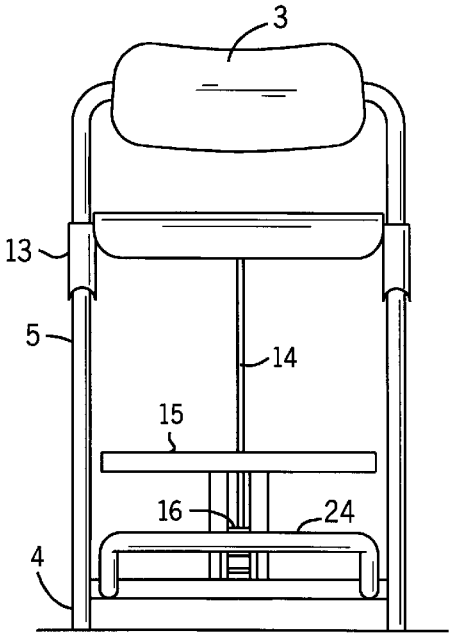
FIG. 2
FIG. 3
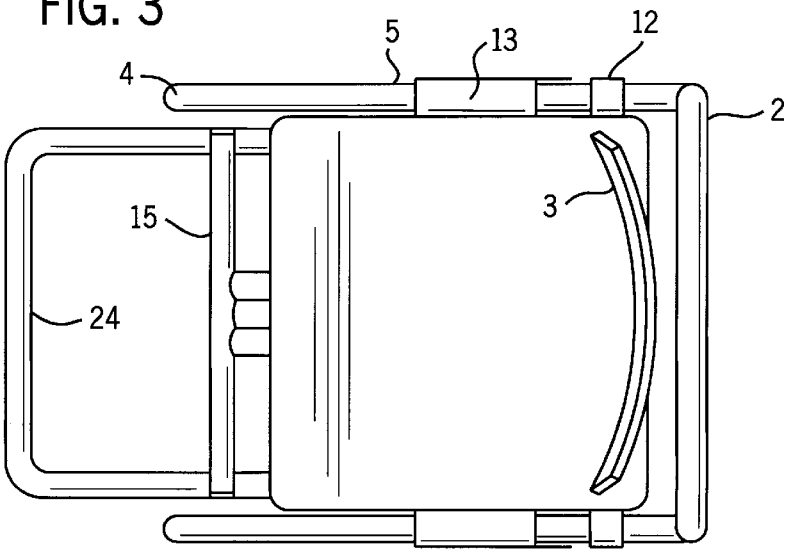

ADJUSTABLE CHAIR

BACKGROUND OF THE INVENTION

The invention relates to a chair having an adjustable seat and an ergonomically cooperating foot support to be used at high tables, especially in schools.

Within the school, tall pupil tables are tried out in order to avoid load damages affecting teachers bending forwardly during guidance, together with tall chairs to prevent back problems affecting pupils, giving them the possibility of changing between usual "passive" sitting position (90° between calf (lower leg) and thigh on the one hand and between thigh and body on the other hand) and a more open "active" sitting position (120° between calf and thigh respectively between thigh and body).

Such a work-place has been developed by DR. A. C. Mandal, Denmark, and is produced i.a. by MK Stålmøobler a.s., DK-5500 Middelfart. Disadvantages consist in that many chair variants are required; the foot support of the chair for "passive" sitting position must be adjusted separately; the table must be adjusted vertically separately; the various levels of the tables differ, and the foot support of the table for "active" sitting position must be adjusted separately.

The same favourable working position is achieved by teacher and pupil if all adjustments are gathered on the chair, using tables positioned at one fixed level. Tables without adjustments are labour-saving and prevent risks for errors. Equal table level is necessary upon grouping.

Such a chair is disclosed in Norwegian patent specifications Nos. 135,118 and 150,743, now cancelled. The disadvantage of this chair is that the vertical distance from seat to tabletop as well as the vertical distance from foot support to seat must be adjusted separately; the chair does not offer any possibility of sitting in an open "active" position, and it is only intended for usual dining table levels.

SUMMARY OF THE INVENTION

The invention is based on the above-mentioned, known solutions, but it has the advantage that when the seat is set at a correct level beneath the tabletop, it is automatically positioned at a correct distance from the back of the chair as well as at a correct level above foot supports for active and passive working positions, gathered in one and the same hand grip. A simple adjustment saves work and prevents risks for errors; the chair offers possibilities for varied sitting positions; the same chair may be used for persons having a difference of 70 cm in body length, simplifying both purchase and storage.

According to the invention, synchronous adjustment is achieved in that, when the seat, as known, is displaced along the guidance portion extending obliquely upwardly and rearwardly, to a desired level below the tabletop at a correct level and distance from the back of the chair, a strut attached to the seat lifts with it the foot support for passive sitting position to a correct distance from the seat. Simultaneously, a strut from foot support for passive sitting position carries another foot support for active sitting position to correct height level in relation to the seat. Seat level and, thus, all other adjustments, are locked in a desired position, the part carrying the seat in a correct angle relative to the underframe (the guidance portion) being attached thereto as known:

A Through friction coating which, by means of the weight of the seat and of the user, locks the seat infinitely variable in correct position on the guidance portion;

B Through friction coating which, by means of the weight of the seat and of the user, locks the seat infinitely variable in correct position on the guidance portion, with the addition of a clamp device of known structure, preventing the seat from being displaced due to a mishap;

C Through a locking pin on the guidance portion, or on the underframe of the seat, said pin engaging a hole in an opposing part and, thus, locking the two parts together in fixed steps at a desired level;

D Through a screw adapted to pull and lock the seat on the guidance portion of the chair, in an infinitely variably chosen position.

The alternatives B, C and D are adapted to be controlled by the user without tools, but the chair should also be available in an embodiment which must be controlled and adjusted by means of special tools, e.g. by a caretaker.

BRIEF DESCRIPTION OF THE SEVERAL VIEWS OF THE DRAWING

A method for the use of ergonomically cooperating adjustment of a seat-carrying device according to the invention is shown in the drawings, in which:

FIG. 1 shows the chair in section/side elevational view;

FIG. 2 shows the same in a front view;

FIG. 3 shows the same as seen from above;

DETAILED DESCRIPTION OF THE INVENTION

Figure 4:
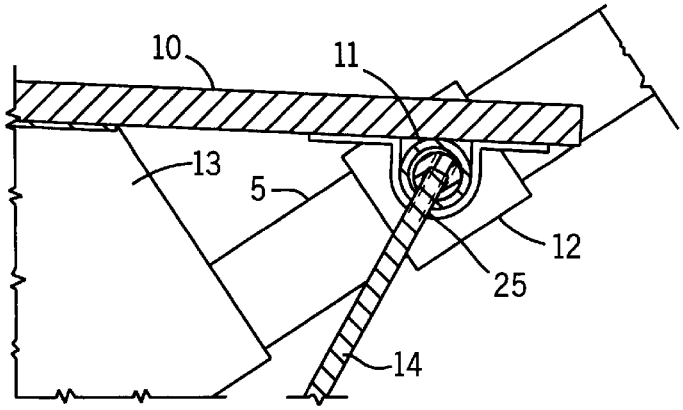
FIG. 4 shows a detail of a lifting strut below the seat.
Figure 5:
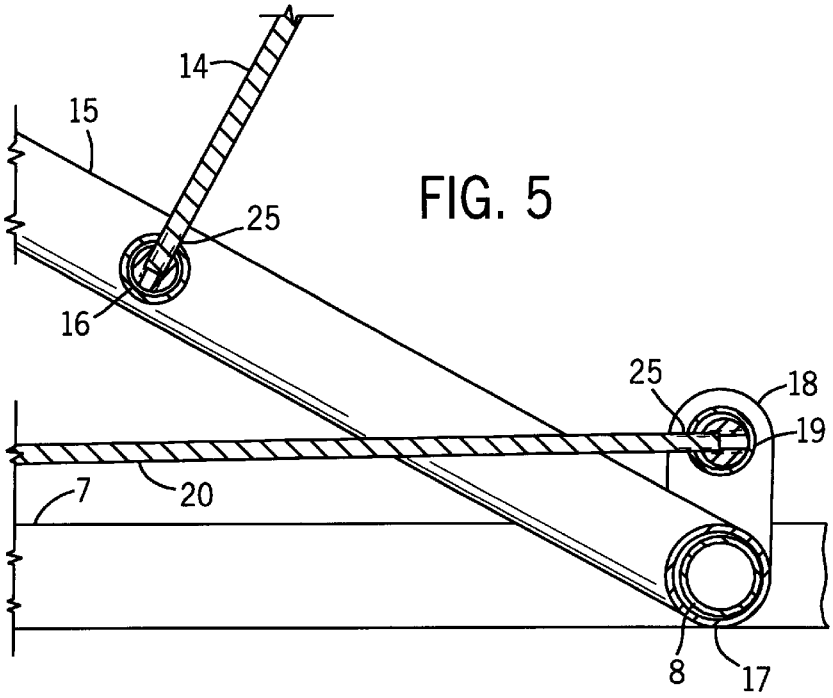
FIG. 5 shows a detail of the lifting strut in lifting axis and pushing strut in rear annular fastener.
Figure 6:
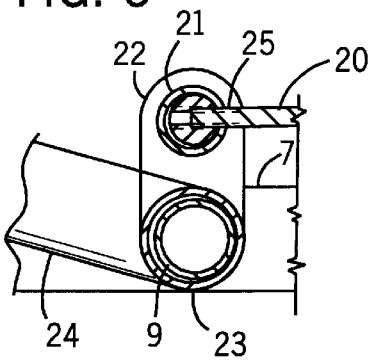
FIG. 6 shows the pushing strut in the front annular fastener.

The fixed structure of the chair consists of rear bars 1 having a fixed lateral connection 2 at the upper edge thereof. The back 3 is attached to the lateral connection. From the lower ends thereof, the front legs 4 of the chair are bent to transit into inclined guidance rails 5, each of which has an upper fixed connection 6 to the rear bars 1. Additionally, the front legs 4 and the rear bars 1 have a fixed connection through longitudinal struts 7 in the form of horizontal pipes adjacent the floor. The longitudinal struts 7 are connected to rear and front lateral struts 8 and 9, respectively, bracing the chair and forming an axis for the foot supports.

The adjustable structure of the chair consists of the seat 10 which, at the rear edge, is pivotally attached through a horizontal, lateral seat shaft 11 fastened to sleeves such as 12 sliding along the guidance rails 5. The seat 10 is rigidly connected to a carrier 13, maintaining it in the correct angle above the guidance rails 5. The carrier 13 is attached to the guidance rails in a known manner, i.e. through friction coating or friction coating plus clamp or pin engaging hole or screw; this previously known attaching method is not further described herein. To the seat shaft 11, a lifting strut 14 is rotatably attached. The lower end of the lifting strut 14 is rotatably attached (16) to a foot support 15. The rear foot support shaft 17 rotates around the rear lateral strut and is equipped with a rear ring fastener 18 for an eccentric fastener 19 transferring forces through a sliding or pushing strut 20 to an eccentric fastener 21 on a front ring fastener 22 on a front foot support shaft 23 and, thus, positions the front foot support 24 in a desired position.

The inclined position of the guidance rails 5, carrying the seat towards the back 3 with a larger horizontal than vertical motion component, the positioning of the lifting strut's 14 fastener to the seat, the distance from the lifting strut's 14 shaft 16 to the rear foot support shaft 17, the distance from the centre of the foot support shaft 17 and 23 to the fasteners 18 and 22 for the sliding or pushing strut, bring the chair's cooperating functional measures—distance between seat, back, rear and front foot supports—into ergonomic position in relation to each other according to average measures of a human body.

Adjustment of lifting and sliding/pushing struts adjusts the level of the foot support for people having a leg length which is out of proportion with the rest of the body. With simple hand grips, one may adjust the chair to correct sitting position for users having differing body sizes and proportions.

I claim:

1. An adjustable chair for adaptation to a working table, the chair comprising:

a chair frame member including a pair of inclined, parallel guidance rails;

a vertically adjustable seat retainable at various levels along the guidance rails, the seat being rigidly attached to a carrier having slide means slidable upward and downward along the guidance rails, the slide means being retainable along the guidance rails through releasable retaining means acting between the inclined guidance rails and the slide means;

a vertically adjustable foot support having a first end and a second end, the second end of the foot support including a foot resting portion, the first end of the foot support being articulated to the chair frame member and pivotable about a horizontal, laterally extending rotational axis positioned below the seat; and a lifting strut having a first end articulated to the foot support at an intermediate position of the foot support spaced from the rotational axis and a second end articulated to the seat, wherein the lifting strut pivots the foot support about the rotational axis as the seat moves along the guidance rails such that a first distance between the foot resting portion of the foot support and the seat changes as the seat is vertically adjusted along the guidance rails.

2. The adjustable chair as set forth in claim 1, wherein the foot support comprises a rear foot support and a front foot support each having a foot resting portion, the foot resting portions being spaced at mutually differing distances from the seat, the foot resting portion of the rear foot support being spaced at the first distance from the seat and the foot resting portion of the front foot support being spaced at a second distance from the seat, wherein the first distance is less than the second distance.

3. The adjustable chair as set forth in claim 2, wherein a third distance between an attachment means joining the lifting strut to the foot support and the rotational axis of the rear foot support is dimensioned such that the first distance and the second distance decrease as the seat moves upward along the guidance rails.

4. The adjustable chair as set forth in claim 2 wherein the front foot support is pivotally mounted to the chair frame member so as to be pivotable about a second, horizontal laterally extending rotational axis, the second rotational axis of the front foot support being parallel to and spaced from the rotational axis of the rear foot support.

5. The adjustable chair as set forth in claim 4 wherein the front foot support is connected to the rear foot support by a parallel strut connector, such that the front foot support rotates about the second rotational axis when the rear foot support rotates about its rotational axis.

6. The adjustable chair as set forth in claim 1, wherein a third distance between an attachment means joining the lifting strut to the foot support and the rotational axis of the foot support is dimensioned such that the first distance between the seat and the foot resting portion of the foot support decreases as the seat moves upward along the guidance rails.

7. An adjustable chair comprising a seat that is vertically adjustable for adaptation to a working table where the chair is provided with a vertically adjustable foot support having a foot resting portion, the foot support being rotatably attached to the chair at a horizontal and lateral foot support axis below the seat, and the foot support being connected to the seat by means of a lifting strut adapted to rotate the foot support around the foot support axis, whereby the distance between the foot resting portion of the foot support and the seat is changed when the seat is vertically adjusted, the lifting strut being attached to the foot support and spaced from the foot support axis.

8. The adjustable chair as set forth in claim 7, wherein the foot support comprises a rear foot support and a front foot support each having a foot resting portion, the foot resting portions being spaced at mutually differing distances from the seat, the foot resting portion of the rear foot support being spaced at a first distance from the seat and the foot resting portion of the front foot support being spaced at a second distance from the seat, wherein the first distance is less than the second distance.

9. The adjustable chair as set forth in claim 8 wherein the front foot support is pivotally mounted to the chair frame member so as to be pivotable about a second, horizontal laterally extending rotational axis, the second rotational axis of the front foot support being parallel to and spaced from the foot support axis of the rear foot support.

10. The adjustable chair as set forth in claim 9 wherein the front foot support is connected to the rear foot support by a parallel strut connector, such that the front foot support rotates about the second rotational axis when the rear foot support rotates about its rotational axis.

* * * * *